US007514196B2

(12) United States Patent
Nagai

(10) Patent No.: US 7,514,196 B2
(45) Date of Patent: Apr. 7, 2009

(54) DEVELOPING METHOD AND DEVELOPING UNIT

(75) Inventor: Takashi Nagai, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 235 days.

(21) Appl. No.: 10/586,818

(22) PCT Filed: Feb. 28, 2005

(86) PCT No.: PCT/JP2005/003331

§ 371 (c)(1),
(2), (4) Date: Jul. 20, 2006

(87) PCT Pub. No.: WO2005/083529

PCT Pub. Date: Sep. 9, 2005

(65) Prior Publication Data

US 2008/0213686 A1 Sep. 4, 2008

(30) Foreign Application Priority Data

Feb. 26, 2004 (JP) ..... 2004-051126

(51) Int. Cl.
*G03G 13/06* (2006.01)

(52) U.S. Cl. ..... 430/119.82; 399/276

(58) Field of Classification Search ..... 430/106.1, 430/110.4, 111.4, 119.82; 399/276
See application file for complete search history.

(56) References Cited

U.S. PATENT DOCUMENTS 6,178,306 B1 1/2001 Mizoguchi et al.
2002/0009313 A1* 1/2002 Okamura et al. ..... 399/286
2002/0048468 A1* 4/2002 Sakaizawa et al. ..... 399/150
2002/0055052 A1 5/2002 Komoto et al.
2003/0054275 A1* 3/2003 Sugimoto et al. ..... 430/106.1

FOREIGN PATENT DOCUMENTS

| | | | |
|---|---|---|---|
| CN | 1338664 | A | 6/2002 |
| JP | 55-018656 | A | 2/1980 |
| JP | 11-194618 | A | 7/1999 |
| JP | 2000-321821 | A | 11/2000 |
| JP | 2001-331030 | | 11/2001 |
| JP | 2003-255612 | A | 9/2003 |
| JP | 2003-255710 | A | 9/2003 |

* cited by examiner

*Primary Examiner*—John L Goodrow
(74) *Attorney, Agent, or Firm*—Carmody & Torrance LLP

(57) ABSTRACT

The present invention provides a developing method and a developing unit which can obtain a favorable image quality and the like even when a surface roughness Rz of a developing sleeve is changed or when an amorphous-silicon photoconductor is used by allowing the magnetic monocomponent toner to effectively jump to a photoconductor from a developing sleeve. To attain such an object, the present invention provides a magnetic monocomponent jumping developing system and a developing unit which uses the method, wherein as the magnetic monocomponent toner, a toner having a volume center particle size which is calculated from the particle size distribution based on volume and falls within a range from 6.0 to 7.8 μm, having the sphericity which falls within a range from 0.92 to 0.98, and setting a toner quantity having a volume particle size of 5.04 μm or less to a value which falls within a range from 2.5 to 10.0 volume % is used and, at the same time, assuming a toner quantity per unit area of the toner image as A, a following relationship formula (1) is satisfied.

$$0.6\ \mathrm{mg/cm^2} \leqq A \leqq 0.9\ \mathrm{mg/cm^2} \quad (1)$$

7 Claims, 9 Drawing Sheets

DEVELOPING METHOD AND DEVELOPING UNIT

CROSS REFERENCE TO RELATED APPLICATIONS

This application is a National Stage application of International Application No. PCT/JP2005/003331, filed Feb. 28, 2005.

TECHNICAL FIELD

The present invention relates to a developing method and a developing unit, more particularly to a developing method using a magnetic monocomponent jumping system which can obtain a favorable image property even when a predetermined amorphous-silicon photoconductor is used or even when a surface roughness of a developing sleeve is changed and to a developing unit which uses the method.

RELATED ART

In an image forming apparatus such as a printer, a copying machine or the like, in performing an electrophotography method, a surface of a photoconductor is uniformly charged to a predetermined polarity and, thereafter, an image exposure is performed so as to form an electrostatic charge image. Then, the formed electrostatic charge image is developed by a toner so as to form a toner image on the photoconductor and the toner image is further transferred and fixed to paper. In this manner, the image formation is performed rapidly using the electrophotography.

Further, as developing methods of an electrostatic charge image, there have been known the normal development and the reversal development, under the current situation when digital equipments are widely used, the reversal development has become the mainstream. In this reversal development, a toner image is formed by adhering toner which is charged to the same polarity as the photoconductor to a portion of the photoconductor whose potential is lowered by an image exposure, wherein a portion of the photoconductor which is not irradiated with light constitutes a background portion of the image.

In such an image forming apparatus, there have been usually proposed a means which allows the toner to have a small particle size in a monocomponent developer and a means which allows the toner and the carrier to have small particle sizes or a means which allows the carrier to have low resistance or the like in a two-component developer so as to acquire a high quality image.

Particularly, by allowing the toner to have a small volume center particle size and a spherical shape, the toner which is developed on the photoconductor can increase density thereof, that is, the toner is finely filled and hence, the uniformity of a matted image or a gray image is enhanced so that the development is performed linearly with respect to the exposed dot size thus providing an effective means for the acquisition of high-quality image.

Here, a method which uses the two-component developer may provide favorable images in a relatively stable manner in an initial stage. However, when the method is used for a long period, there arises a drawback that the carrier is deteriorated, that is, a spent phenomenon occurs. Accordingly, there has been observed a drawback that a charge imparting ability of the carrier is lowered so that the favorable image cannot be obtained for a long period or a drawback that the method exhibits the poor durability in use for a long period because it is difficult to maintain a mixing ratio of the toner and the carrier to a fixed value.

Under such circumstances, to obviate such drawbacks, there have been proposed several kinds of developing methods which use a monocomponent developer which contains only toner without using carrier in combination with the toner. Particularly, there has been proposed a developing method which uses a monocomponent developer containing a predetermined quantity of magnetic particles.

As such a magnetic monocomponent developing method, for example, there has been proposed a developing method which is referred to as a magnetic monocomponent jumping method (for example, see patent document 1). More specifically, the method uses a developing unit in which a developer carrying body which is formed of a developing sleeve incorporating a magnetic roller therein is arranged to face a photoconductor in a spaced-apart manner with a predetermined distance there between. Here, the toner is conveyed by rotating the developing sleeve and, at the same time, the toner is made to pass through a gap defined between the developing sleeve and a magnetic blade so that a toner thin layer is formed on the developing sleeve. Subsequently, by allowing the charged toner in the formed toner thin layer to jump to a photoconductor, an electrostatic latent image is developed on a surface of the photoconductor.

[Patent Document 1] JP55-18656A (Claims)

DISCLOSURE OF THE INVENTION

Problems to be Solved by the Invention

However, the developing method described in the patent document 1 uses a magnetic monocomponent toner having a small particle size and a spherical shape and hence, when a developing quantity (A) per unit area on the photoconductor is increased, there has been observed a drawback that the toner is liable to be easily adhered to a background portion (high potential portion) of a printed image. Particularly, when a surface roughness (Rz) of the developing sleeve is changed along with a lapse of time, the conveying property and a condition of the thin layer toner are changed correspondingly and hence, there has been observed a drawback that the toner is liable to be easily adhered to the background portion of the printed image.

Further, in an image forming apparatus using a amorphous-silicon photoconductor, a cleaning blade and a cleaning roller are popularly used as a cleaning device. In such a case, however, there has been also observed a drawback that the adhesion of toner on the printed image is liable to be increased more. That is, along with the increase of the developing quantity on the photoconductor, the post-transfer residual toner which remains on and is adhered to the photoconductor is increased, and the post-transfer residual toner is liable to be forcibly pressed to the photoconductor by the cleaning roller. Accordingly, there has been observed a drawback that a quantity of toner which remains on the photoconductor without being removed by the cleaning blade is increased thus leading to the increase of the adhesion of toner on the printed image. This brings about a new drawback in image printing that black spots are liable to be easily generated on a white-paper image and white spots are liable to be easily generated on a high-density image such as a gray image.

The present invention has been made to overcome such drawbacks and inventors of the present invention have completed the present invention based on a finding that by restricting a volume center particle size, the sphericity, a fine powder quantity having a volume particle size of equal to or less than a predetermined value and a developing quantity of a magnetic monocomponent toner within predetermined ranges respectively, even when a surface roughness (Rz) of a developing sleeve is changed or even when an amorphous-silicon photoconductor is used, it may be possible to allow the magnetic monocomponent toner to effectively jump from the developing sleeve to a photoconductor thus enabling the acquisition of an excellent image quality or the like.

That is, it is an object of the present invention to provide a developing method and a developing unit which are suitable for a magnetic monocomponent jumping developing system, that is, a developing method and a developing unit which can increase the image density and can lower the fogging density while effectively suppress the generation of black spots or white spots by preventing the unnecessary adhesion/retention of the toner to the photoconductor thus realizing a high-quality image.

Means for Solving the Problem

The present invention is directed to a developing method for forming a predetermined toner image by allowing a magnetic monocomponent toner to jump to a photoconductor from a developing sleeve, and developing an electrostatic latent image formed on the photoconductor, wherein as the magnetic monocomponent toner, a toner having a volume center particle size which falls within a range from 6.0 to 7.8 μm, having the sphericity which falls within a range from 0.92 to 0.98, and setting a toner quantity (fine powder quantity) having a volume particle size of 5.04 μm or less to a value which falls within a range from 2.5 to 10.0 volume % is used and, at the same time, assuming a toner quantity (developing quantity) per unit area of the toner image as (A), a following relationship formula (1) is satisfied thus overcoming the above-mentioned drawbacks.

$$0.6\ \text{mg/cm}^2 \leqq A \leqq 0.9\ \text{mg/cm}^2 \quad (1)$$

That is, according to the developing method of the present invention based on a jumping developing system of the magnetic monocomponent toner, by restricting the values of the volume center particle size, the sphericity and the fine powder quantity of the toner within the predetermined ranges and, at the same time, by restricting the value of the developing quantity (A) on the photoconductor within the predetermined range, even when the surface roughness (Rz) of the developing sleeve is changed or even when an amorphous-silicon photoconductor is used, it may be possible to allow the magnetic monocomponent toner to efficiently and accurately jump to the photoconductor from the developing sleeve. Accordingly, it may be possible to lower the fogging density while maintaining the high image density thus preventing the adhesion of toner to a background portion of the image in the reversal development. Further, it may be possible to effectively prevent a defective image such as the generation of black spots or white spots attributed to the adhesion of toner. Further, by increasing the value of the toner quantity per unit area on the photoconductor (A) attributed to the small particle size of the toner per se, it may be also possible to enhance the reproducibility of the dot image.

Further, in carrying out the developing method of the present invention, assuming the surface roughness of the developing sleeve as (Rz), it may be preferable that the surface roughness (Rz) satisfies a following relationship formula (2).

$$3.0\ \mu\text{m} \leqq \text{Rz} \leqq 5.5\ \mu\text{m} \quad (2)$$

That is, by setting the value of the surface roughness (Rz) of the developing sleeve within the predetermined range, it may be possible to form a toner thin layer having a uniform thickness and hence, the fogging density may be lowered while maintaining the high image density whereby the adhesion of toner may be decreased.

Further, in carrying out the developing method of the present invention, assuming the toner quantity per unit area of the toner thin layer formed on the developing sleeve as (B), it may be preferable that a following relationship formula (3) is satisfied.

$$0.6\ \text{mg/cm}^2 \leqq B \leqq 0.90\ \text{mg/cm}^2 \quad (3)$$

That is, by setting the value of the developing quantity (B) which is the toner quantity per unit area of the toner thin layer formed on the developing sleeve within the predetermined range, it may be possible to develop the toner more uniformly on the surface of the photoconductor and hence, the fogging density may be lowered while maintaining the high image density and, at the same time, the reproducibility of dots may be further enhanced.

Further, in carrying out the developing method of the present invention, it may be preferable that the photoconductor is an amorphous-silicon photoconductor, and a cleaning blade and a cleaning roller are used in combination as a cleaning device.

That is, even when the amorphous-silicon photoconductor which includes the predetermined cleaning device is used, it may be possible to lower the fogging density while maintaining the high image density thus further reducing the adhesion of toner for a long period.

Further, in carrying out the developing method of the present invention, it may be preferable that the magnetic monocomponent toner is manufactured such that the resin composition is prepared by adding 30 to 120 parts by weight of magnetic powder, 0.1 to 10 parts by weight of a charge control agent and 1 to 10 parts by weight of wax into 100 parts by weight of binding resin, the resin composition is pulverized by a turbo mill and, thereafter, the pulverized resin composition is classified using an Alpine classifier.

With the use of the magnetic monocomponent toner manufactured in this manner, it may be possible to more easily restrict the values of the volume center particle size, the sphericity and the fine power quantity of the toner within the predetermined ranges. Accordingly, the fogging density may be lowered while maintaining the high image density and, at the same time, it may be also possible to reduce the adhesion of toner.

Another aspect of the present invention is directed to a developing unit for forming a predetermined toner image by allowing a magnetic monocomponent toner to jump to a photoconductor from a developing sleeve and developing an electrostatic latent image formed on the photoconductor, wherein as the magnetic monocomponent toner, a toner having a volume center particle size which falls within a range from 6.0 to 7.8 μm, having the sphericity which falls within a range from 0.92 to 0.98, and setting a toner quantity (fine powder quantity) having a volume particle size of 5.04 μm or less to a value which falls within a range from 2.5 to 10.0 volume % is used and, at the same time, assuming a toner quantity per unit area of the toner image as A, a following relationship formula (1) is satisfied.

$$0.6\ \text{mg/cm}^2 \leqq A \leqq 0.9\ \text{mg/cm}^2 \quad (1)$$

That is, according to the developing unit of the present invention based on a jumping developing system of the magnetic monocomponent toner, by restricting the values of the volume center particle size, the sphericity and the fine powder quantity of the toner within the predetermined ranges and, at the same time, by restricting the value of the developing quantity (A) on the photoconductor within the predetermined range, even when the surface roughness (Rz) of the developing sleeve is changed or even when an amorphous-silicon photoconductor is used, it may be possible to allow the magnetic monocomponent toner to efficiently and accurately jump to the photoconductor from the developing sleeve. Accordingly, it may be possible to lower the fogging density while maintaining the high image density and, at the same time, it may be possible to reduce the adhesion of toner.

Further, in forming the developing unit of the present invention, when the surface roughness of the developing sleeve is set as (Rz), it may be preferable that the surface roughness (Rz) satisfies a following relationship formula (2).

$$3.0\ \mu m \leqq Rz \leqq 5.5\ \mu m \quad (2)$$

That is, a toner thin layer having a uniform thickness and a uniform toner quantity (B) may be formed on the developing sleeve by setting the surface roughness (Rz) of the developing sleeve to a value within a predetermined range and as a result, the uniform developing can be performed with respect to the photoconductor. Accordingly, the fogging density may be lowered while maintaining the high image density and, at the same time, it may be possible to reduce the adhesion of toner.

Further, in forming the developing unit of the present invention, assuming the toner quantity per unit area of the toner thin layer formed on the developing sleeve as (B), it may be preferable that a following relationship formula (3) is satisfied.

$$0.6\ mg/cm^2 \leqq B \leqq 0.90\ mg/cm^2 \quad (3)$$

That is, by setting the value of the developing quantity (B) which is the toner quantity per unit area of the toner thin layer formed on the developing sleeve within the predetermined range, it may be possible to develop the toner more uniformly on the surface of the photoconductor and hence, the fogging density may be lowered while maintaining the high image density and, at the same time, the reproducibility of dots may be further enhanced.

Further, in forming the developing unit of the present invention, it may be preferable that the photoconductor is an amorphous-silicon photoconductor and that a cleaning blade and a cleaning roller are used in combination as a cleaning device.

That is, even when the amorphous-silicon photoconductor which includes a predetermined cleaning device is used, it may be possible to lower the fogging density while maintaining the high image density and, at the same time, to decrease the adhesion of toner for a long period.

BEST MODE FOR CARRYING OUT THE INVENTION

First Embodiment

Figure 1:
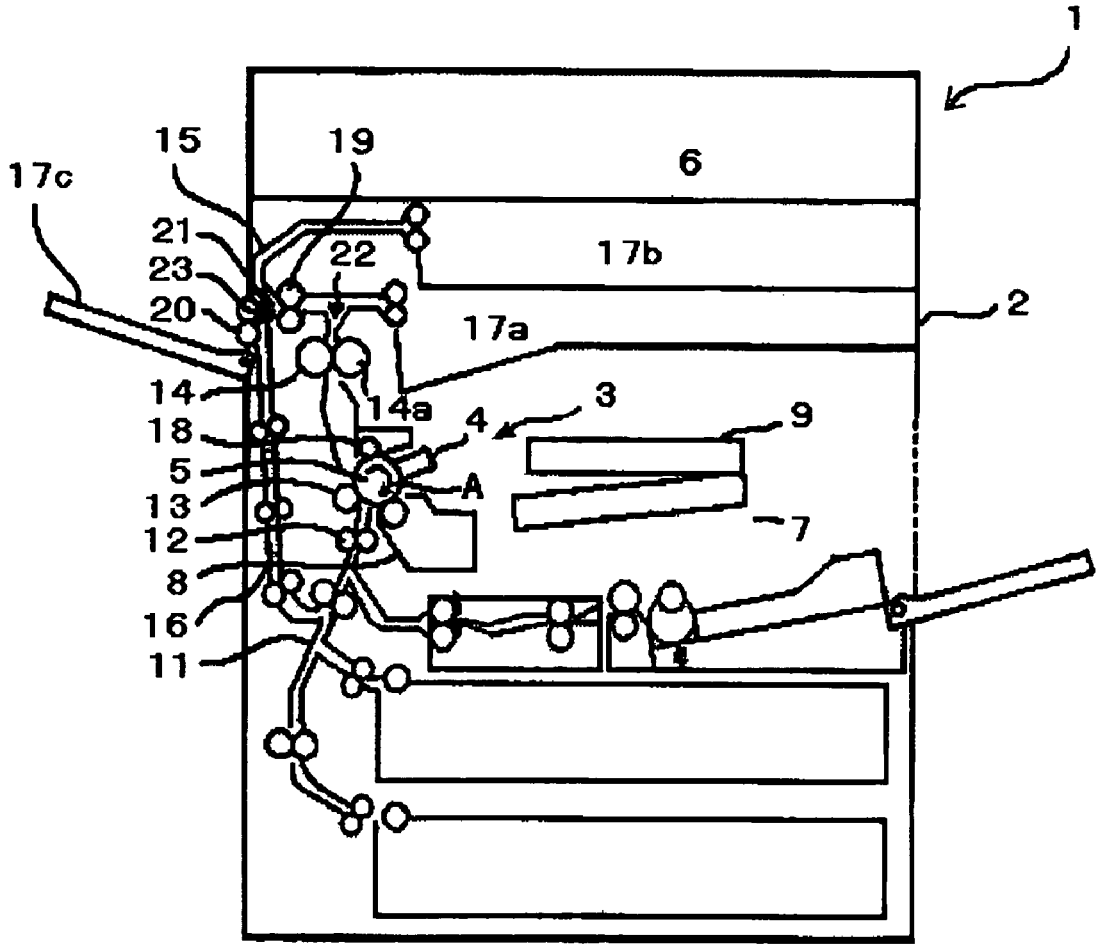
FIG. 1 is a view for explaining an image forming apparatus provided with a developing unit.

A first embodiment is directed to a developing method for forming a predetermined toner image by allowing a magnetic monocomponent toner to jump to a photoconductor from a developing sleeve, and developing an electrostatic latent image formed on the photoconductor, that is, a developing method based on a magnetic monocomponent jumping developing system. As the magnetic monocomponent toner, a toner having a volume center particle size which falls within a range from 6.0 to 7.8 μm, having the sphericity which falls within a range from 0.92 to 0.98, and setting a toner quantity (fine powder quantity) having a volume particle size of 5.04 μm or less to a value which falls within a range from 2.5 to 10.0 volume % is used and, at the same time, assuming a toner quantity (developing quantity) per unit area of the toner image as (A), a following relationship formula (1) is satisfied.

$$0.6\ mg/cm^2 \leqq A \leqq 0.9\ mg/cm^2 \quad (1)$$

A developing method according to the first embodiment is explained herein after by classifying the developing method into the magnetic monocomponent jumping developing system and the toner suitably in conjunction with drawings.

1. Magnetic Monocomponent Jumping Developing System (1) Developing Method

In forming a toner image on a photoconductor 5 by using an image forming apparatus (a digital composite machine) 1 shown in FIG. 1, that is, in carrying out the developing method of the present invention, generally, a developer which contains a toner is supplied onto a developing sleeve 8*a* which incorporates a magnet therein in a state that a triboelectric charge of positive-polarity is applied to the developer so as to form a toner thin layer having a uniform thickness and a uniform toner quantity on the developing sleeve 8*a*. Further, when the toner thin layer is conveyed to a developing position which faces the photoconductor 5, an AC bias is applied between the photoconductor 5 and the rotating developing sleeve 8*a* and hence, the toner jumps to the photoconductor 5 thus forming a toner image on a surface of the photoconductor 5.

Here, it may be preferable that a surface roughness (Rz) of the developing sleeve in use satisfies the relationship of 3.0 μm≦Rz≦5.5 μm.

By allowing the surface roughness to satisfy such relationship, while ensuring the smooth conveyance of the toner to the surface of the developing sleeve, it may be possible to allow a toner quantity (B) per unit area on the developing sleeve to fall within a predetermined range and to become uniform. Accordingly, it may be possible to adjust the toner quantity formed on the photoconductor to a proper quantity thus realizing the acquisition of high resolution and high image quality.

This is because that when the surface roughness (Rz) of the developing sleeve is set to a value less than 3.0 μm, there may arise a tendency that the conveyance of the toner to the surface of the developing sleeve is lowered and hence, the toner quantity (B) on the surface of the developing sleeve may be lowered or become non-uniform. As a result, a toner quantity of a toner image developed on the photoconductor does not fall within a predetermined range.

On the other hand, when the surface roughness (Rz) of the developing sleeve is set to a value more than 5.5 μm, the toner in which a charging amount thereof cannot be controlled is increased. Accordingly, a thickness or a toner quantity (B) of the toner thin layer formed on the developing sleeve becomes non-uniform. As a result, there may arise a case that it is difficult to adjust a toner quantity (A) formed on the photoconductor such that the toner quantity (A) falls within a proper range.

Particularly, in using an amorphous-silicon photoconductor, when the value of the surface roughness (Rz) does not fall within a predetermined range, the leaking of the toner to the photoconductor from projecting portions on the surface of the developing sleeve is liable to be easily generated and hence, a possibility that image black spots are generated is increased.

Accordingly, it may be more preferable that the surface roughness (Rz) of the developing sleeve in use satisfies the relationship 3.1 μm≦Rz≦5.3 μm, and it may be further preferable that the surface roughness (Rz) of the developing sleeve in use satisfies the relationship 3.3 μm≦Rz≦5.1 μm.

Here, the surface roughness (Rz) of the developing sleeve means the ten-point average roughness (Rz) prescribed in JIS B0601-1994. Further, the ten-point average roughness (Rz) may be measured by using a surface roughness meter such as Surfcorder SE-30D (produced by Kosaka Laboratory Ltd.), for example.

Further, aluminum, stainless steel (SUS) or the like may be named as the material constituting the developing sleeve. Particularly, to take the durability and easiness of controlling the surface roughness (Rz) into consideration, it may be further preferable to use stainless steel, wherein SUS303, 304, 305, 316 or the like may be specifically named.

(2) Image Forming Method

Figure 2:
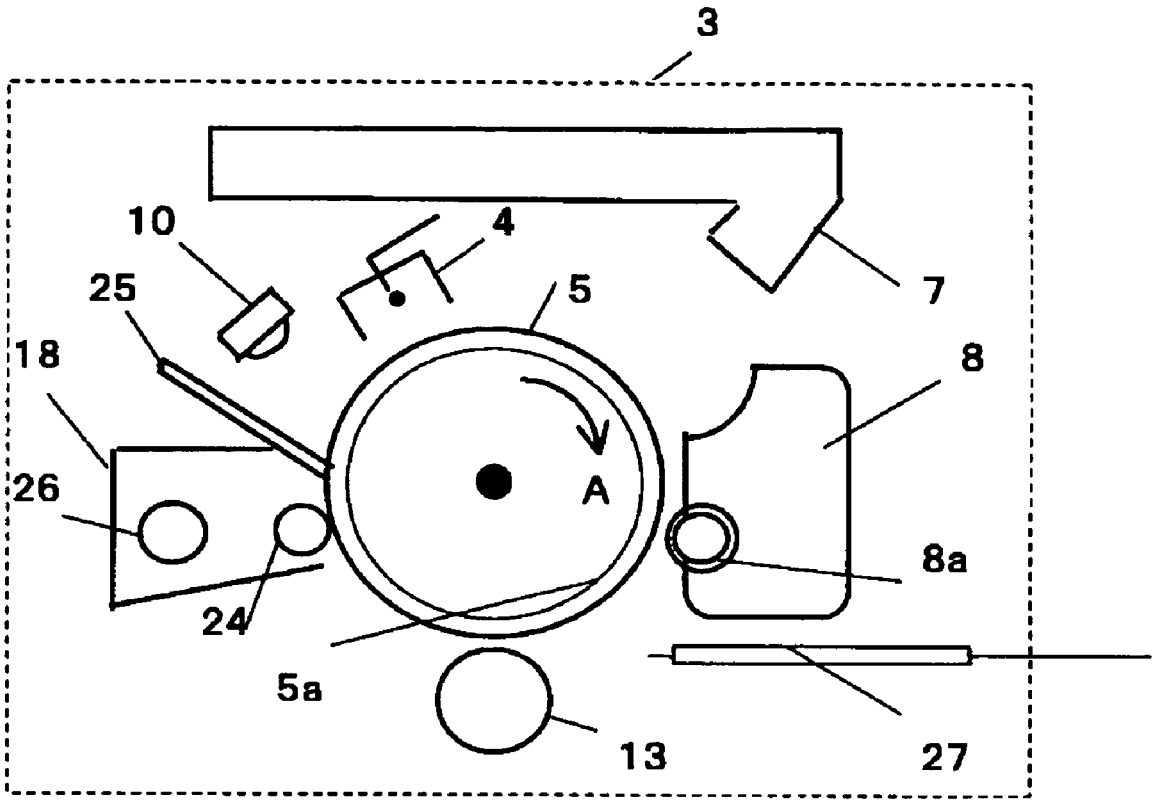
FIG. 2 is an enlarged view of the vicinity of a photoconductor in the image forming apparatus.

Further, FIG. 1 shows an image forming apparatus 1 to which the developing method of the present invention is applied and a digital composite machine is shown as an example. FIG. 2 is an enlarged view which shows the vicinity of the photoconductor 5 (also referred to as a photoconductor drum) in the image forming apparatus 1 in an enlarged manner. As shown in FIG. 2, in an image forming part 3 in the inside of a main body of the composite machine 2 which constitutes a main component of the digital composite machine 1, along the rotating direction (the direction indicated by an arrow A) of the photoconductor 5, a charging unit 4, an exposure unit 7, a developing unit 8, a transfer roller 13, a cleaning roller 24, a cleaning blade 25 and a charge elimination device 10 are arranged.

Here, the photoconductor 5 is formed by laminating a photoconductor layer which is made of amorphous silicon (a-Si) on a surface of an aluminum-made drum, for example, wherein the surface of the photoconductor 5 is charged by the charging unit 4. Further, on the surface of the photoconductor 5 which receives laser beams from the exposure unit 7 based on document image data read out from an image reading portion 6, an electrostatic latent image whose charging quantity is attenuated is formed.

The charging unit 4 charges the surface of the photoconductor 5 by discharging (for example, corona-discharging). For example, the charging unit 4 is configured such that a wire or the like having a small diameter is used as an electrode and the discharge is performed by applying a predetermined high power voltage to the wire.

The exposure unit 7 is a member which serves to form an electrostatic latent image on the surface of the photoconductor 5 by irradiating optical beams (for example, laser beams) to the photoconductor 5 based on image data.

The developing unit 8 includes, as described above, a developing sleeve 8*a* which is arranged to face the photoconductor 5 in an opposed manner. The developing unit 8 performs the development by making the developer conveyed from a toner container 9 adhere to an electrostatic latent image formed on the photoconductor 5 by using the developing sleeve 8*a* thus forming a toner image.

Further, after the charge is eliminated by a charge elimination device 10, an electrostatic latent image is recorded on the photoconductor 5 which is uniformly charged by the charging unit 4 by the exposure unit 7. The electrostatic latent image is visualized as a toner image in the developing unit 8 by reversal development and, thereafter, the toner image is transferred onto paper to which the toner is transferred by using a transfer roller 13. Non-transferred toner which is not transferred by the transfer roller 13 is removed from the surface of the photoconductor 5 as a residual toner by a cleaning roller 24 and a cleaning blade 25 in a cleaning portion 18. Still further, the removed residual toner is fed to a disposal bottle not shown in the drawing by a toner recovering device such as a recovery screw 26 and the like.

Further, the paper to which the toner image is transferred is separated from the photoconductor 5 as shown in FIG. 1 and, thereafter, is conveyed to a fixing portion 14 having a pair of fixing rollers 14*a* so that the toner image is fixed. That is, the paper to which the toner image is transferred is introduced into a fixing device which is constituted of a pair of heat roller (fixing rollers) and pressing roller, wherein the toner image is fixed to a surface of the paper by heat and pressure while the paper is made to pass through the fixing device.

The paper which is made to pass through the fixing portion 14 in this manner is fed to the paper feeding passage 15 which is branched in a plurality of directions where the feeding direction of the paper is sorted out by passage switching mechanisms 21, 22, 23 having a plurality of passage switching guides which are provided at a branching point of the paper feeding passage 15. Then, the paper is, directly or after the paper is fed to the paper feeding passage 16 and both sides of the paper are copied, the paper is discharged to a paper discharge portion anyone of a first discharge tray 17*a*, a second discharge tray 17*b* and a third discharge tray 17*c*.

On the other hand, a predetermined polishing treatment is applied to the surface of the photoconductor after transferring the toner image by bringing the photoconductor into frictional contact with a cleaning roller so that the surface of the photoconductor is cleaned simultaneously with the polishing treatment. Thereafter, the surface of the photoconductor is further cleaned by a cleaning device consisting of a cleaning blade and the like and the toner remaining on the surface of the photoconductor is removed. Subsequently, the charge on the surface of the photoconductor is eliminated by the radiation of light or the like by using an LED or the like and hence, a cycle of forming an image is completed. Then, the next image forming becomes possible.

2. Magnetic Monocomponent Toner (1) Volume Center Particle Size

The volume center particle size of the magnetic monocomponent toner (simply also referred to as "toner"hereinafter), that is, the center particle size which is calculated from the particle size distribution of the toner based on volume may be set to a value which falls within a range of 6.0 to 7.8 μm.

The reason is that when the volume center particle size of the toner is set to a value less than 6.0 μm, the quantity of fine powder is remarkably increased or the control of the sphericity becomes difficult. On the other hand, when the volume center particle size of such toner exceeds 7.8 μm, the filling property within a predetermined volume is lowered and hence, the adjustment of the value of the toner quantity per unit area on the developing sleeve (B) or the value of the developing quantity (A) which means the toner quantity per unit area in the toner image becomes difficult.

Accordingly, it may be more preferable to set a volume center particle size of the toner to a value which falls within a range from 6.1 to 7.7 μm, and it may be further preferable to set a volume center particle size of the toner to a value which falls within a range from 6.3 to 7.5 μm.

Here, the volume center particle size of the toner may be calculated from the particle size distribution which is measured based on volume by using, for example, Coulter Multisizer TA-2 (made by Beckman Coulter, Inc.).

More specifically, initially approximately 1% of NaCl solution is prepared as an electrolytic solution by using primary sodium chloride. It is needless to say that an existing electrolytic solution may be used in place of the NaCl solution and ISOTON-II (made by Coulter Scientific Japan Inc.) may be named as such an existing solution, for example. Next, in measuring the volume particle size of the toner, in 100 to 150 ml of the prepared electrolytic aqueous solution, 0.1 to 5 ml of a surfactant (preferably an alkyl benzene sulfonic acid chloride) is added as a dispersant. Further, 2 to 20 mg of a sample whose particle size distribution is to be measured is added and mixed into the solution thus obtaining a suspended electrolytic solution. After accommodating the suspended electrolytic solution in the inside of an ultrasonic dispersing unit, an ultrasonic dispersion treatment is performed for one to three minutes to produce a measurement sample. Subsequently, by using Coulter Multisizer TA-2, the volume and the number of toner particles at respective channels are measured while using 100 μm apertures as apertures thereof and, thereafter, the volume distribution and the number distribution of the toner may be calculated by the measured values. That is, the particle size distribution based on volume is measured by using a particle size distribution measuring device and the volume center particle size of the toner may be calculated from the particle size distribution of the toner.

(2) Sphericity

Further, the sphericity of the toner is set to a value which falls within a range from 0.92 to 0.98.

The reason is that when the sphericity of the toner is set to a value less than 0.92, the adjustment of the value of toner quantity per unit area on the developing sleeve (B) or the value of developing quantity as the toner quantity per unit area of the toner image (A) becomes difficult.

On the other hand, when the sphericity of the toner exceeds 0.98, a yield rate in classifying is remarkably lowered or a control of the volume center particle size becomes difficult.

Accordingly, it may be preferable to set the sphericity of the toner to a value which falls within a range from 0.93 to 0.97.

Figure 3:
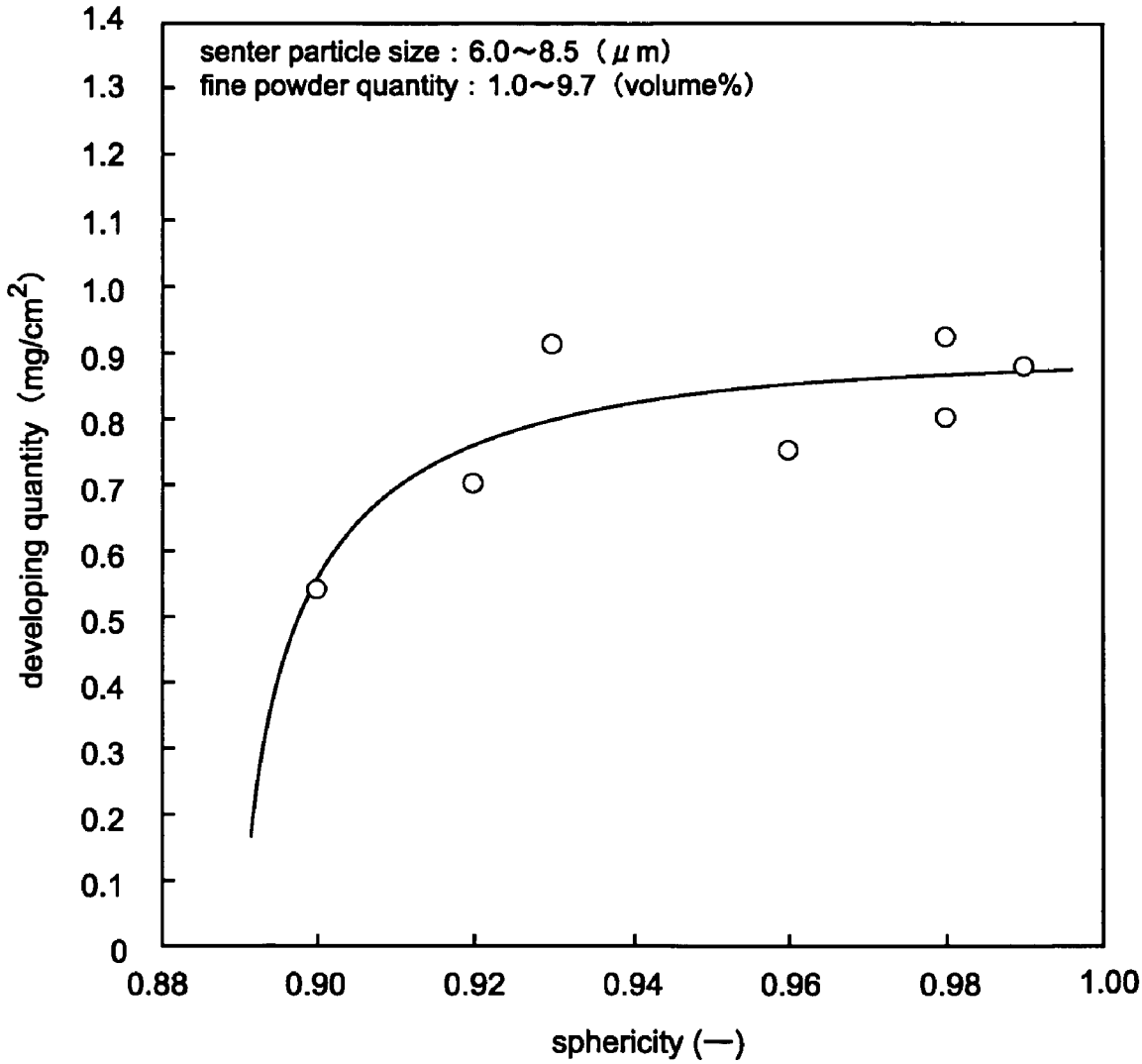
FIG. 3 is a view for explaining the relationship between the sphericity of a toner and a developing quantity on the photoconductor.

Here, the relationship between the sphericity of the toner and the developing quantity which is the toner quantity per unit area of the toner image (A) is explained in detail in conjunction with FIG. 3. In FIG. 3, the sphericity of toner (–) is taken on an axis of abscissas and the developing quantity on the photoconductor (mg/cm$^2$) is taken on an axis of ordinates. Further, the data in FIG. 3 corresponds to examples 1 to 3 and comparison examples 2 to 5 described later. Here, the data in the comparison example 1 is omitted from the data in FIG. 3 since the quantity of fine powder is 13.2 weight %, that is, the quantity of fine powder is extremely large.

As may be understood from FIG. 3, when the sphericity of the toner is set to a value which falls within a range from 0.89 to 0.93, corresponding to the increase of the sphericity of the toner, the developing quantity of the toner on the photoconductor is also remarkably increased. That is, the developing quantity of the toner is set to a value which falls within a range from approximately 0.2 to 0.87 g/cm$^2$. On the other hand, when the sphericity of the toner exceeds 0.93, even when the sphericity of the toner is increased, the developing quantity of the toner on the photoconductor is set to a substantially constant value.

Accordingly, although the relationship between the sphericity and the volume center particle size of the toner, the fine powder quantity or the like may have to be taken into consideration, so long as the sphericity of the toner is set to a value which falls within a range from 0.92 to 0.98, the developing quantity of the toner on the photoconductor may be controlled to a relatively high value.

Figure 4:
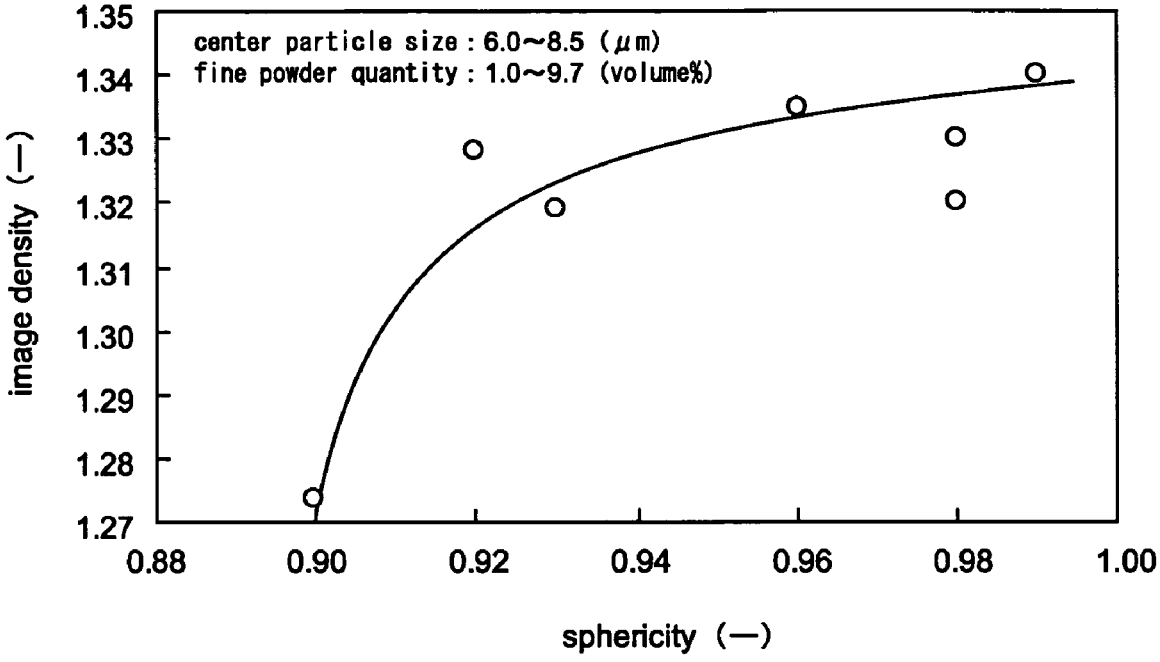
FIG. 4 is a view for explaining the relationship between the sphericity of the toner and the image density.

Next, the relationship between the sphericity of the toner and the image density is explained in detail in conjunction with FIG. 4. In FIG. 4, the sphericity of the toner (–) is taken on an axis of abscissas and the image density (–) when the predetermined image forming is performed on the photoconductor is taken on an axis of ordinates. That is, the data shown in FIG. 4 corresponds to the data shown in the examples 1 to 3 and the comparison examples 2 and 3 which are described herein after. Here, since the data of the first comparison example indicates an extremely large fine toner particle quantity, that is, 13.2 weight %, the data is eliminated from FIG. 4.

As may be understood from FIG. 4, when the sphericity of the toner is set to a value which falls within a range from 0.90 to 0.92, corresponding to the increase of the sphericity of the toner, the value of the image density is also remarkably increased and takes a value which falls within a range from approximately 1.27 to 1.32. Further, when the sphericity of the toner is set to a value which falls within a range approximately from 0.92 to 0.99, corresponding to the increase of the sphericity of the toner, the value of the image density is liable to be gradually increased.

Accordingly, although the relationship between the sphericity and the volume center particle size of the toner, the quantity of fine powder or the like may have to be taken into consideration, when the sphericity of the toner is set to a value which falls within a range from 0.92 to 0.98, it may be possible to set the image density when the predetermined image forming is performed on the photoconductor to a value at least equal to or more than 1.3.

Here, the above-mentioned sphericity of the toner may be expressed by a following formula and the sphericity of the toner may be measured by using a flow-type particle image analyzing apparatus, more specifically, a FPIA series (made by SYSMEX CORPORATION) or the like. To be more specific, after filling 100 to 150 ml of water from which impure solid materials are preliminarily eliminated in a container, a surfactant, preferably 0.1 to 0.5 ml of an alkylbenzene sulfonate, is added to the water as a dispersant, and, thereafter, 0.1 to 0.5 g of a magnetic toner which is an object for measuring the sphericity is added in the solution. Then, the dispersion treatment is applied to the water for one to three minutes by using an ultrasonic dispersing unit and the dispersion concentration of the solution is adjusted to a value which falls within a range from 3000 to 10000 unit/μl and the solution is used as a sample. Next, by using a FPIA series (made by SYSMEX CORPORATION), the sphericity of the toner is measured.

With the use of the flow type particle image analyzing apparatus, the number average particle size of the magnetic toner is measured. By setting a predetermined number average particle size, the sphericity and the average sphericity of the magnetic toner which falls within a range of predetermined number average particle size are automatically calculated. That is, with the use of the flow type particle image analyzing apparatus, a particle projection image of the toner may be measured. Further, based on a result of the measurement of the particle projection image of the toner, a circumferential length (cm) of a circle having an area identical with as the particle projection area of the toner and a circumferential length (cm) of the particle projection image may be respectively measured. Accordingly, the sphericity of the toner may be obtained by using the following formula.

sphericity of toner(−)=circumferential length of circle having area identical with the particle projection area (cm)/average value of circumferential length of particle projection image (cm)

(3) Fine Powder Quantity

Further, a quantity of toner (a fine powder quantity of toner) having a volume particle size of 5.04 μm or less is set to a value which falls within a range from 2.5 to 10.0 volume % with respect to the total quantity of the toner.

The reason is that when the fine powder quantity of the toner assumes a value less than 2.5 volume %, a yield rate in classifying is remarkably lowered and, the toner quantity on the developing sleeve (B) or the toner quantity on the photoconductor (A) is excessively increased thus easily generating the adhesion of toner. On the other hand, when the fine powder quantity of the toner exceeds 10 volume %, it is difficult to control the sphericity or the volume center particle size of the toner. That is, when the fine powder quantity becomes excessively large, there may be a case that the toner quantity on the developing sleeve (B) or the toner quantity on the photoconductor (A) is remarkably lowered irrelevant to the sphericity or the volume center particle size of the toner.

Accordingly, it may be more preferable to set the fine powder quantity of the toner to a value which falls within a range from 2.5 to 9.0 volume %, and it may be further preferable to set the fine powder quantity of the toner to a value which falls within a range from 3.0 to 8.0 volume %.

Figure 5:
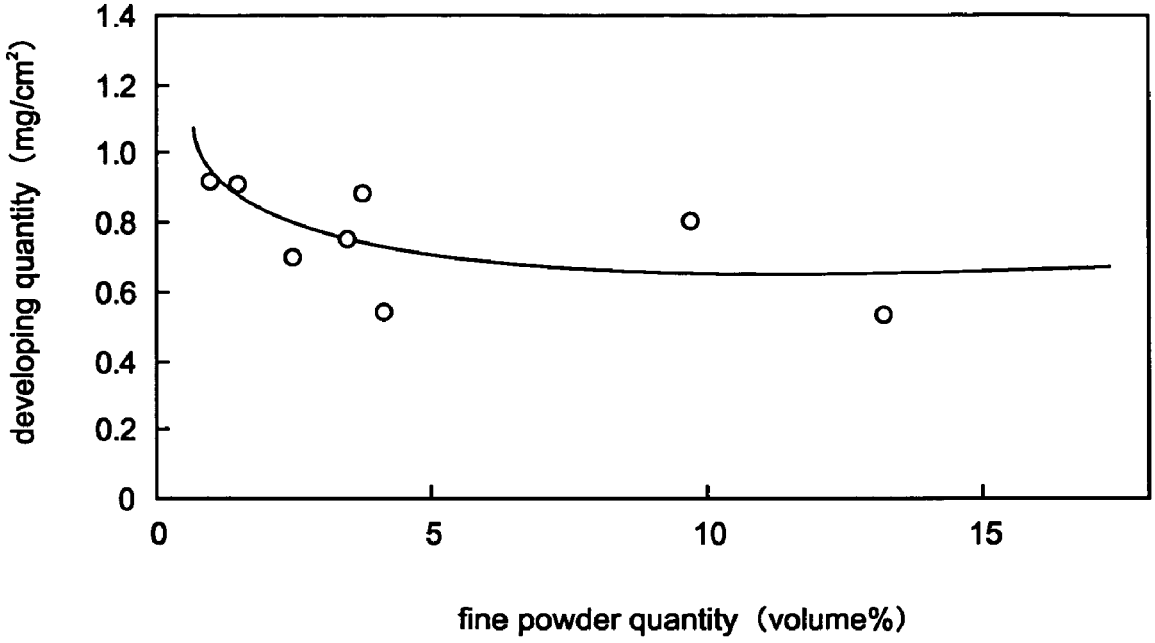
FIG. 5 is a view for explaining the relationship between the fine powder quantity of the toner and the developing quantity on the photoconductor.

Here, in conjunction with FIG. 5, the relationship between the fine powder quantity of the toner and the developing quantity of the toner on the photoconductor (A) which is the toner quantity per unit area on the toner image is explained in detail. In FIG. 5, the fine powder quantity of the toner (volume %) is taken on an axis of abscissas and the developing quantity on the photoconductor (mg/cm$^2$) is taken on an axis of ordinates. Here, data in FIG. 5 corresponds to the examples 1 to 3 and the comparison examples 1 to 5 described later.

As may be understood from FIG. 5, when the fine powder quantity of the toner is set to a value which falls within a range from 1 to 2 volume %, along with the increase of the fine powder quantity of the toner, the developing quantity on the photoconductor is remarkably lowered and assumes a value which falls within a range approximately from 0.9 to 0.8 g/cm$^2$. Further, when the fine powder quantity of the toner assumes a value which falls within a range approximately from 2 volume % to 10 volume %, along with the increase of the toner fine powder quantity, the developing quantity of the toner on the photoconductor is gradually lowered and assumes a value which falls within a range from 0.8 to 0.7 g/cm$^2$. Further, when the fine powder quantity of the toner exceeds 10 volume %, there observed is a tendency that the developing quantity of the toner on the photoconductor is slightly lowered.

Accordingly, although the relationship between the fine powder quantity and the volume center particle size, the sphericity of the toner or the like may have to be taken into consideration, by setting the fine powder quantity of the toner to a value which falls within a range from 2.5 to 10 volume %, it may be possible to control the developing quantity of the toner on the photoconductor to a relatively high value.

Here, the reason that the toner having the volume center particle size of 5.04 μm or less is measured as an object of measurement with respect to the fine powder quantity of the toner is that it is found from an experiment conducted separately that the sufficient correlation exists between a quantity of the toner having the volume center particle size of 5.04 μm or less and the sphericity or the volume center particle size of the toner.

Further, the fine powder quantity of the toner may be measured simultaneously with the measurement of the volume center particle size of the toner. That is, in the same manner as the volume center particle size of the toner, by measuring the particle size distribution based on volume by using a particle size distribution measuring apparatus, for example, Coulter Multisizer TA-2 (made by Beckman Coulter, Inc.), the fine powder quantity of the toner may be calculated from the particle size distribution.

(4) Developing Quantity

Further, assuming the developing quantity on the photoconductor which is the toner quantity adhered per unit area of the toner image as (A), the following relationship (1) is satisfied.

$$0.6\ \text{mg/cm}^2 \leqq A \leqq 0.9\ \text{mg/cm}^2 \quad (1)$$

The reason is that when the developing quantity of the toner is set to 0.6 mg/cm$^2$ or less, the value of the image density may be lowered or fluctuated. For example, the image density which is measured under the condition described in the example 1 and the like is lowered to a value less than 1.3.

On the other hand, when the developing quantity of the toner exceeds 0.9 mg/cm$^2$, the transfer residual toner which is adhered to the photoconductor is increased and hence, the residual toner may be easily and firmly pressed and adhered to the photoconductor by a cleaning roller. Accordingly, the quantity of the adhered toner which remains on the photoconductor without being cleaned is increased.

Accordingly, it may be preferable to set the developing quantity of the toner to a value which falls within a range from 0.65 to 0.8 mg/cm$^2$, and it may be further preferable to set the developing quantity of the toner to a value which falls within a range from 0.68 to 0.78 mg/cm$^2$.

Figure 6:
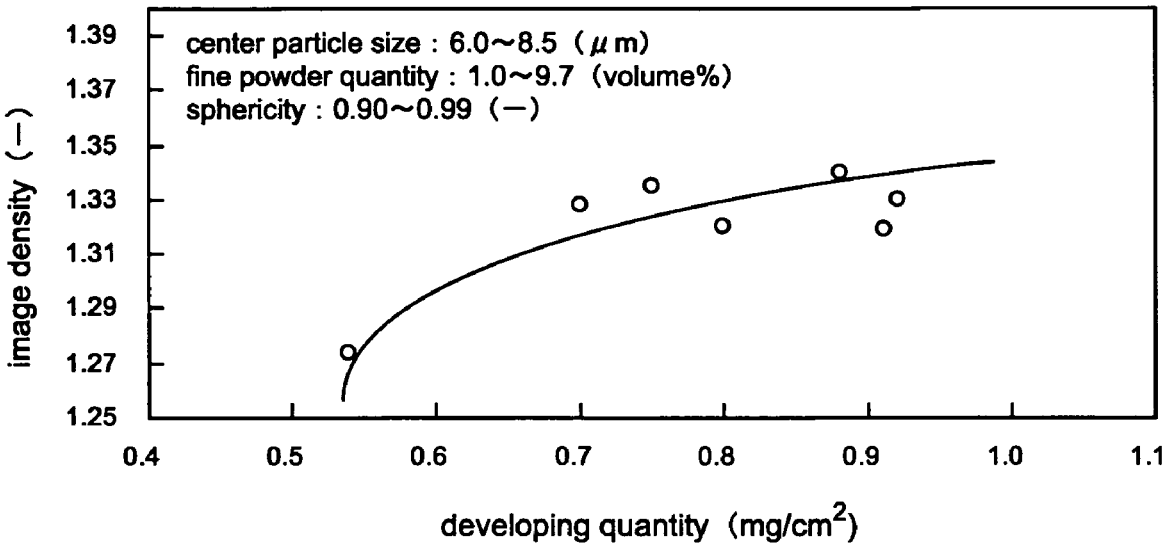
FIG. 6 is a view for explaining the relationship between the developing quantity on the photoconductor and the image density.

Next, the relationship between the developing quantity on the photoconductor (A) which is the toner quantity per unit area of the toner image and the image density is explained in detail in conjunction with FIG. 6.

In FIG. 6, the developing quantity on the photoconductor (mg/cm$^2$) is taken on an axis of abscissas and the image density (−) is taken on an axis of ordinates. Further, the data shown in FIG. 6 corresponds to the examples 1 to 3 and the comparison examples 2 to 5. Here, the data of the first comparison example 1 indicates an extremely large fine powder quantity, that is, 13.2 weight % and hence, the data is eliminated from FIG. 6.

As may be understood from FIG. 6, when the developing quantity on the photoconductor (A) is set to a value which falls within a range from 0.5 to 0.7 mg/cm$^2$, along with the increase of the developing quantity on the photoconductor (A), the image density is remarkably increased and takes a value which falls within a range from 1.26 to 1.32. Further, when the developing quantity on the photoconductor (A) exceeds 0.7 mg/cm$^2$, even when the developing quantity on the photoconductor (A) is increased, the image density is maintained at a fixed high level of 1.33 to 1.34.

Accordingly, although the relationship between the developing quantity on the photoconductor (A) and the volume center particle size of the toner or the like also may have to be taken into consideration, as long as the developing quantity on the photoconductor (A) is set to a value which falls within a range from 0.6 to 0.9 mg/cm$^2$, it may be possible to control the image density to a relatively high value.

Figure 7:
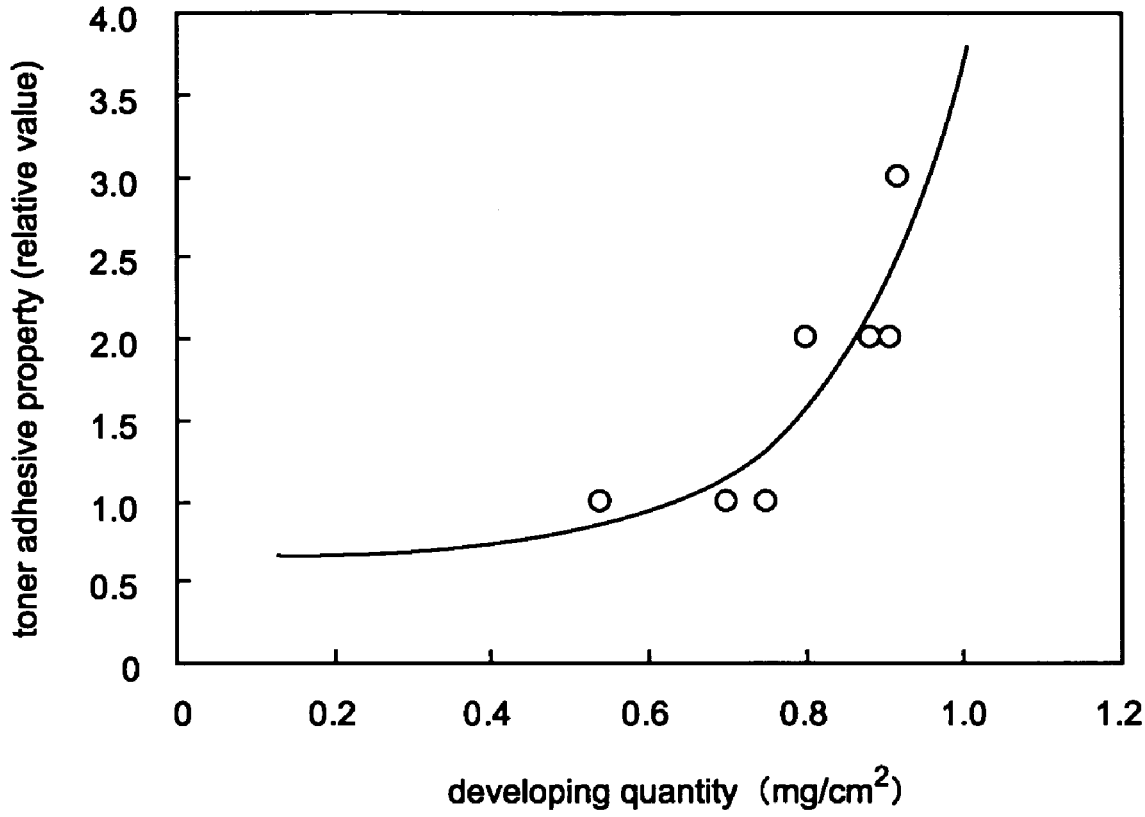
FIG. 7 is a view for explaining the relationship between the developing quantity on the photoconductor and the evaluation level of the adhesion of toner.

Next, the relationship between the developing quantity on the photoconductor (A) and the evaluation level of the toner adhesive property is explained in detail in conjunction with FIG. 7. In FIG. 7, the developing quantity on the photoconductor (mg/cm$^2$) is taken on an axis of abscissas and an evaluation level of the toner adhesive property (an absolute value) is taken on an axis of ordinates. Further, the data shown in FIG. 7 corresponds to the example 1 to the example 3 and the comparison examples 2 to 5.

As may be understood from FIG. 7, when the developing quantity on the photoconductor (A) assumes a value which falls within a range from 0.4 to 0.8 mg/cm$^2$, even when the developing quantity on the photoconductor (A) is increased, the evaluation level of the toner adhesive property (the absolute value) is not changed and is maintained at a low level of 1. On the other hand, when the developing quantity on the photoconductor (A) exceeds 0.8 mg/cm$^2$, along with the increase of the developing quantity on the photoconductor (A), the evaluation level of the adhesion of toner (relative value) is increased and hence, the relative value assumes a value which falls within a range from 2 to 3.

Accordingly, although the relationship between the developing quantity of the photoconductor (A) and the volume center particle size of the toner or the like also may have to be taken into consideration, so long as the developing quantity on the photoconductor (A) is set to a value which falls within a range from 0.6 to 0.9 mg/cm$^2$, it may be possible to control the evaluation level of the toner adhesive property (the absolute value) below a desired value while ensuring a certain degree of a margin.

Figure 8:
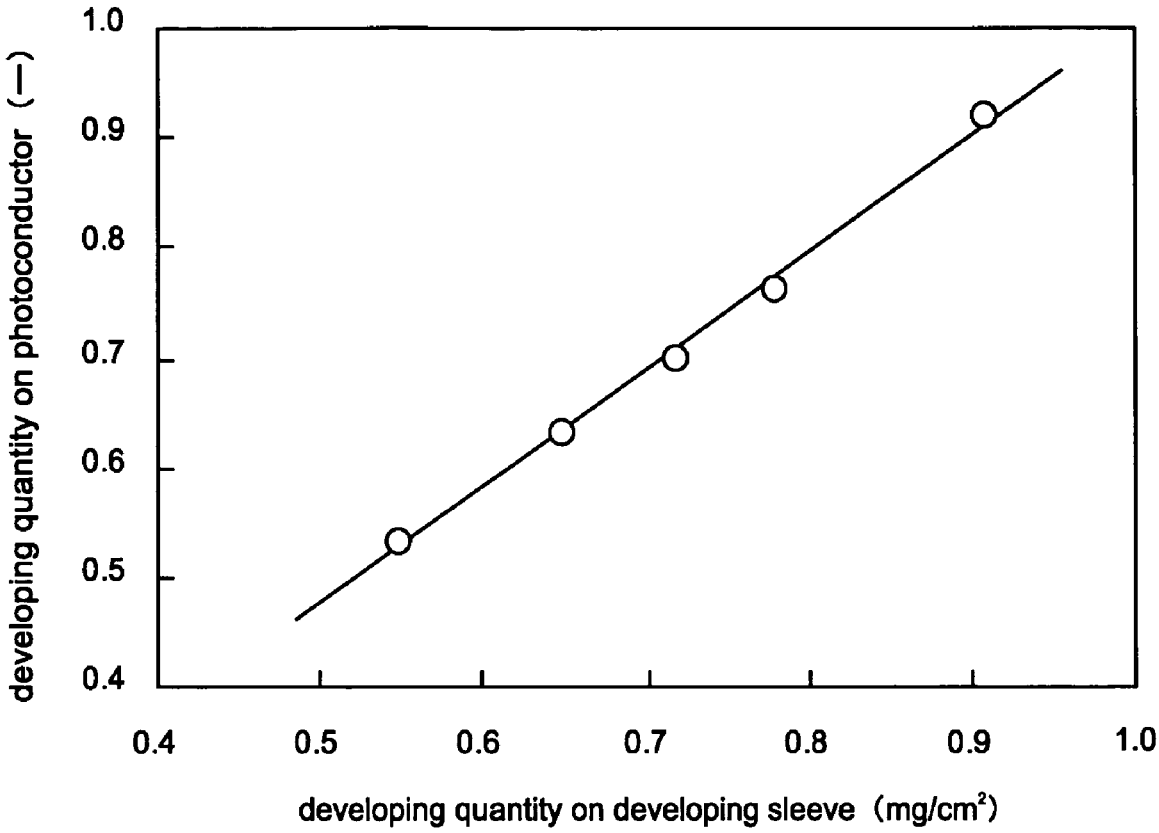
FIG. 8 is a view for explaining the relationship between the developing quantity on the photoconductor and the developing quantity of the developing sleeve.

Next, the relationship between the developing quantity on the photoconductor (A) and the toner quantity per unit area on the developing sleeve, that is, the developing quantity on the developing sleeve (B) is explained in detail in conjunction with FIG. 8. In FIG. 8, the developing quantity on the photoconductor (mg/cm$^2$) is taken on an axis of abscissas and the developing quantity on the developing sleeve (B) is taken on an axis of ordinates. Further, the data shown in FIG. 8 is a result of evaluation which is obtained by separately forming toners different from the toners which are used in the developer of the examples 1 to 3 and the comparison examples 1 to 5.

As may be understood from FIG. 8, when the developing quantity on the developing sleeve (B) assumes a value which falls within a range approximately from 0.5 to 0.8 mg/cm$^2$, the relationship between the developing quantity on the developing sleeve (B) and the developing quantity on the photoconductor (A) substantially exhibits a straight line.

Accordingly, although the relationship between the developing quantity and the volume center particle size of the toner or the like also may have to be taken into consideration, by properly adjusting the developing quantity on the developing sleeve (B), it may be possible to easily control the developing quantity on the photoconductor (A) to a value which falls within a range from 0.5 to 0.8 mg/cm$^2$.

Here, the developing quantity (A) which is a toner quantity per unit area on the photoconductor, as shown in the example 1 or the like described later, may be measured by developing the toner in a state that a developing bias voltage is applied between a developer supply side (developing sleeve) and the photoconductor. Accordingly, the developing quantity of the toner may be adjusted based on a value of the developing bias voltage in addition to particle conditions of the toner per se (particle size, particle size distribution etc.). That is, to adjust the developing quantity of toner (A) within a predetermined range, the developing quantity of the toner on the photoconductor (A) may be measured by applying an AC bias potential which is formed by superposing a DC potential of 250 to 350V and an AC potential (frequency: 1 to 5 Hz) of 0.5 to 2.0 KV (amplitude) to each other as a developing bias voltage (potential applied to the developing sleeve).

On the other hand, the developing quantity (B) which is the toner quantity per unit area on the developing sleeve may be also measured in accordance with the method for measuring the developing quantity on the photoconductor (A) with some modification.

(5) Bulk Density

Further, it may be preferable to set a bulk density of the toner to a value which falls within a range from 0.35 to 0.55 g/cm$^3$. By setting the bulk density to such a value, in combination with the above-mentioned specific configuration of the toner or the volume average particle size, it may be possible to obtain an image having a higher image quality.

Here, the bulk density of the toner may be measured as follows. That is, 30 g of magnetic monocomponent toner is filled in a container and is gently filled into a funnel having a sieve. Subsequently, a receptacle having a volume of 30 cm$^3$ is placed below the funnel and the magnetic toner on the sieve is stirred for 90 seconds with a brush thus making the magnetic toner drop from the sieve in a dispersed manner. Finally, a weight of the magnetic toner in the inside of the receptacle is measured and the bulk density of the toner may be calculated using a following formula.

$$\text{Bulk density (g/cm}^3\text{)} = \text{weight of magnetic toner (g)} / \text{volume of receptacle (cm}^3\text{)}$$

(6) Constituent (6)-1 Binding Resin

Although the binding resin which is one of constituents of the toner is not specifically limited, as the binding resin, a thermoplastic resin such as a styrene resin, an acrylic resin, a styrene-acrylic copolymer resin, a polyolefin resin such as polyethylene or polypropylene, a vinyl chloride resin, a polyester resin, a polyamide resin, a polyurethane resin, a polyvinyl alcohol resin, a vinyl ether resin, an N-vinyl resin or a styrene-butadiene resin may be preferably used.

Among these thermoplastic resins, it may be particularly preferable to use the styrene resin which is a single polymer of a styrene monomer, the styrene-acrylic copolymer which is a copolymer of the styrene monomer and an acrylic monomer or the polyester resin which is obtained by condensation polymerization or copolycondensation of a polyhydric alcohol component and a polycarboxylic acid component.

However, to enhance the offset resistance property or to enhance the toner modulus, when necessary, it may be preferable to use a cross-linking agent or a thermosetting resin in combination with the above-mentioned thermoplastic resin. Further, it may be also preferable to partially introduce the cross-linked structure.

Further, it may be preferable to set a softening point of such a binding resin (measured by a Koka-type flow tester) to a value which falls within a range from 110 to 150° C. and, it may be further preferable to set the softening point of the binding resin to a value which falls within a range from 120 to 140° C. Here, the softening point of the binding resin may be measured by the Koka-type flow tester.

Further, it may be preferable to set the glass transition point (Tg) of the binding resin to a value which falls within a range from 55 to 70° C. so as to prevent the obtained toner from being fused to each other thus lowering the preservation stability and to ensure the fixing property of the toner. Here, the glass transition point of the binding resin may be obtained based on a change point of specific heat using a differential scanning calorimeter (DSC).

(6)-2 Charge Control Agent

In the toner used in the present invention, to remarkably enhance a charge level or a charge rise characteristic (an index to indicate whether the toner is charged to a fixed charge level in a short time or not) thus providing excellent properties such as excellent durability and excellent stability to the toner, a charge control agent, particularly, a positive charge control agent may be mixed. Further, it may be preferable to set an adding quantity of the charge control agent to a value which falls within a range from 0.1 to 10 parts by weight per 100 parts by weight of the binding resin. It may be further preferable to set the adding quantity of the charge control agent to a value which falls within a range from 1 to 5 parts by weight per 100 parts by weight of the binding resin.

Further, as specific examples of the positive charge control agent, a direct dye made of an azine compound; a nigrosine compound such as nigrosine, nigrosine salt, nigrosine derivative; an acidic dye made of a nigrosine compound such as nigrosine BK, nigrosine NB, nigrosine Z; a metallic salt of naphthenate or a higher fatty acid; a quaternary ammonium salt such as alkoxylated amine, alkylamide, benzylmethylhexyldecyl ammonium, and decyltrimethyl ammonium chloride or the like may be exemplified. These components may be used in a single form or in combination of two or more kinds of these components. Particularly, the use of the nigrosine compound is optimum from a viewpoint of the acquisition of the more rapid charge rise characteristic.

Further, a resin or an oligomer which contains a quaternary ammonium salt, a resin or an oligomer which contains a carboxylic acid salt, a resin or an oligomer which contains carboxyl group or the like may be also used as a positive charging controlling agent.

(6)-3 Wax

It may be preferable that a wax is mixed into the toner used in the present invention to enhance the fixing property or the offset property. Here, it may be preferable to set an adding quantity of the wax to a value which falls within a range from 1 to 10 parts by weight per 100 parts by weight of the binding resin, and it may be further preferable to set the adding quantity of the wax to a value which falls within a range from 2 to 5 parts by weight per 100 parts by weight of the binding resin.

The reason is that by setting the adding quantity of the wax to the value which falls within such a range, the fixing property is improved and, at the same time, the offset property and the image smearing may be prevented more effectively. Further, by setting the adding quantity of the wax to the value which falls within such a range, the volume center particle size, the sphericity and the fine powder quantity of the toner can be adjusted more easily.

Further, as the kind of the wax, one kind of or the combination of two or more kinds of the waxes selected from a group consisting of a polyethylene wax, a polypropylene wax, a fluorine type wax, a fischer-tropsch wax, a paraffin wax, an ester wax, a montan wax, a rice wax and the like, for example, may be named.

(6)-4 Magnetic Powder

Further, the magnetic monocomponent toner contains magnetic powder in the binding resin, wherein it may be preferable to mix the magnetic powder in the binding resin such that an adding quantity of the magnetic powder is set to a value which falls within a range from 30 to 120 parts by weight per 100 parts by weight of the binding resin and it may be further preferable to mix the magnetic powder in the binding resin such that the adding quantity of the magnetic powder is set to a value which falls within a range from 50 to 100 parts by weight. This is because that it may be possible to supply the magnetic monocomponent toner alone as a monocomponent toner to the developing region by making use of a magnetic force without using a magnetic carrier or the like. Further, by setting the adding quantity of the magnetic powder within such a range, it may be possible to easily adjust the volume center particle size, the sphericity and also the fine powder quantity of the toner.

Further, as kinds of such magnetic powder, one kind of or the combination of two or more kinds of triiron tetraoxide ($Fe_3O_4$), iron sesquioxide ($\gamma$-$Fe_2O_3$), iron oxide zinc ($ZnFe_2O_4$), iron oxide yttrium ($Y_3Fe_5O_{12}$), iron oxide cadmium ($CdFe_2O_4$), iron oxide gadolinium ($Gd_3Fe_5O_{12}$), iron oxide copper ($CuFe_2O_4$), iron oxide lead ($PbFe_{12}O_{19}$), iron oxide neodymium ($NdFeO_3$), iron oxide barium ($BaFe_{12}O_{19}$), iron oxide manganese ($MnFe_2O_4$), iron oxide lanthanum ($LaFeO_3$), ferrites, iron powder (Fe), cobalt powder (Co), nickel powder (Ni) and the like may be named, for example.

Further, a shape of particles of the magnetic toner is not particularly limited and hence, the particles are allowed to have an arbitrary shape such as a spherical shape, a cubic shape, an indeterminate shape or the like. Further, it may be preferable to set the average particle size of the magnetic powder to a value which falls within a range from 0.1 to 1 μm, and more particularly to a value which falls within a range from 0.1 to 0.5 μm.

Still further, it may be also preferable to apply the surface treatment to the surface of the magnetic powder by using a titanium coupling agent or a silane coupling agent.

(7) Additive

Further, to the toner (toner particles), when necessary, it may be possible to add one kind of or the combination of two or more kinds of the inorganic fine particles (usually having average particle size of 0.3 ||m or less) such as colloidal silica, hydrophobic silica, alumina, titanium oxide, zinc oxide, magnesium oxide, calcium carbonate and the like, organic fine powder made of polymethyl methacrylate or the like, a fatty acid metallic salt such as zinc stearate and the like. Due to such an addition of additive, the fluidity, the preservation stability and the like of the toner particles may be remarkably improved.

Further, when fine particles made of alumina, titanium oxide or the like are added to the toner, it may be possible to properly polish the surface of the photoconductor and hence, an image deletion may be effectively prevented. Further, by adding the above-mentioned additive to the toner, the adhesive force of toner to the surface of the photoconductor may be lowered and hence, the adhesion of toner to the surface of the photoconductor may be prevented.

Here, it may be preferable that the additive is used such that an adding quantity of the additive is set to a value which falls within a range which does not impair original properties of the toner. For example, it may be preferable to set the adding quantity of the additive to a value which is equal to or less than 2.0 parts by weight per 100 parts by weight of the toner particles.

Second Embodiment

The second embodiment is directed to a developing unit for forming a predetermined toner image by allowing a magnetic monocomponent toner to jump from a developing sleeve by a magnetic monocomponent jumping developing system and developing an electrostatic latent image formed on a photoconductor, wherein as the magnetic monocomponent toner, a toner having a center particle size which is calculated based on the particle size distribution based on volume and falls within a range from 6.0 to 7.8 μm, having the sphericity which falls within a range from 0.92 to 0.98, and containing 2.5 to 10.0 volume % of a toner having a volume particle size of 5.04 μm or less is used and, at the same time, assuming a toner quantity per unit area of the toner image as (A), a following relationship formula (1) is satisfied.

$$0.6\ \text{mg/cm}^2 \leqq A \leqq 0.9\ \text{mg/cm}^2 \quad (1)$$

Hereinafter, the developing unit of the second embodiment is specifically explained suitably in conjunction with the drawings by focusing on points which make the second embodiment different from the first embodiment.

First of all, the basic constitution of the developing unit is explained. That is, for example, a developing unit 8 shown in FIG. 9 may be used as such a developing unit. This developing unit 8 includes a developer carrying body 81 which fixedly incorporates a magnet roller 81*b* in a developing sleeve 8*a*, a first agitating/conveying member 82 having a spiral shape, and a second spiral agitating/conveying member 83 having a spiral shape in the same manner. Further, on an upper right portion of the developing sleeve 8*a*, a blade (developer controlling member) 85 which mounts a magnet 85*a* on a lower side thereof is arranged in a spaced-apart manner from the developing sleeve 8*a* with a predetermined distance there between. The magnet roller 81*b* which is incorporated in the developing sleeve 8*a* has a portion thereof which is positioned opposite to the blade magnetized with a magnetic pole S2 (a first magnetic pole) and a portion thereof which is positioned away from the magnetic pole S2 in the clockwise direction by approximately 80° magnetized with a magnetic N2 (a second magnetic pole).

On the other hand, the magnet roller 81*b* has a portion thereof which is positioned opposite to the photoconductor 1 magnetized with a magnetic pole N1 (a third magnetic pole) and a portion thereof which is positioned away from the magnetic pole N1 in the counterclockwise direction by approximately 80° magnetized with a magnetic S1 (a fourth magnetic pole). Accordingly, when a shortage of the toner quantity in the inside of the developing unit 8 is detected by a toner sensor 84, the toner "t" is supplied to the developing unit 8 from a toner hopper (not shown in the drawing). The supplied toner "t" is agitated and is conveyed by the second agitating/conveying member 83 in the depth direction from a reader's side on the drawing and is conveyed to the first agitating/conveying member 42 from the second agitating/conveying member 83 at a depth end portion. Then, the toner is agitated and conveyed by the first agitating/conveying member 82 in the reader's side direction from the depth portion on the drawing and is supplied to the developing sleeve 8*a* on the way.

That is, the toner "t" which is agitated by the first agitating/conveying member 82 and the second agitating/conveying member 83 is attracted to the developing sleeve 8*a* by a magnetic force of the magnetic pole N2 which is applied to the magnet roller 81*b*. Subsequently, the toner "t" is conveyed to a gap portion defined between the blade 85 and the developing sleeve 8*a* along with the rotation of the developing sleeve. When the toner "t" passes through the gap portion, the quantity of toner to be conveyed to the developing portion is restricted by the magnetic pole S2 and the blade 85 and, at the same time, a toner thin layer is formed on the developing sleeve 8*a*. Further, a triboelectric charge is applied to the toner "t". It is needless to say that the toner is also charged by a friction which is mainly generated between the toner "t" and the developing sleeve during a period that the toner "t" is conveyed to the developing sleeve 8*a*. Further, an electrostatic latent image formed on the photoconductor 5 is developed by the toner "t" which is conveyed to the developing portion which constitutes a region facing the photoconductor 5 in an opposed manner.

Here, in developing the toner, a developing bias voltage is applied to the gap defined between a developer supply side (developing sleeve) and the photoconductor 5. As the developing bias voltage (a potential applied to the developing sleeve), for example, an AC bias potential which is generated by overlapping a DC potential of 250 to 350V and an AC potential of 0.5 to 2.0 KV (amplitude) may be used. Further, the frequency of the AC potential may be set to approximately 1 to 5 Hz, for example.

(2) Image Forming Method

Figure 9:
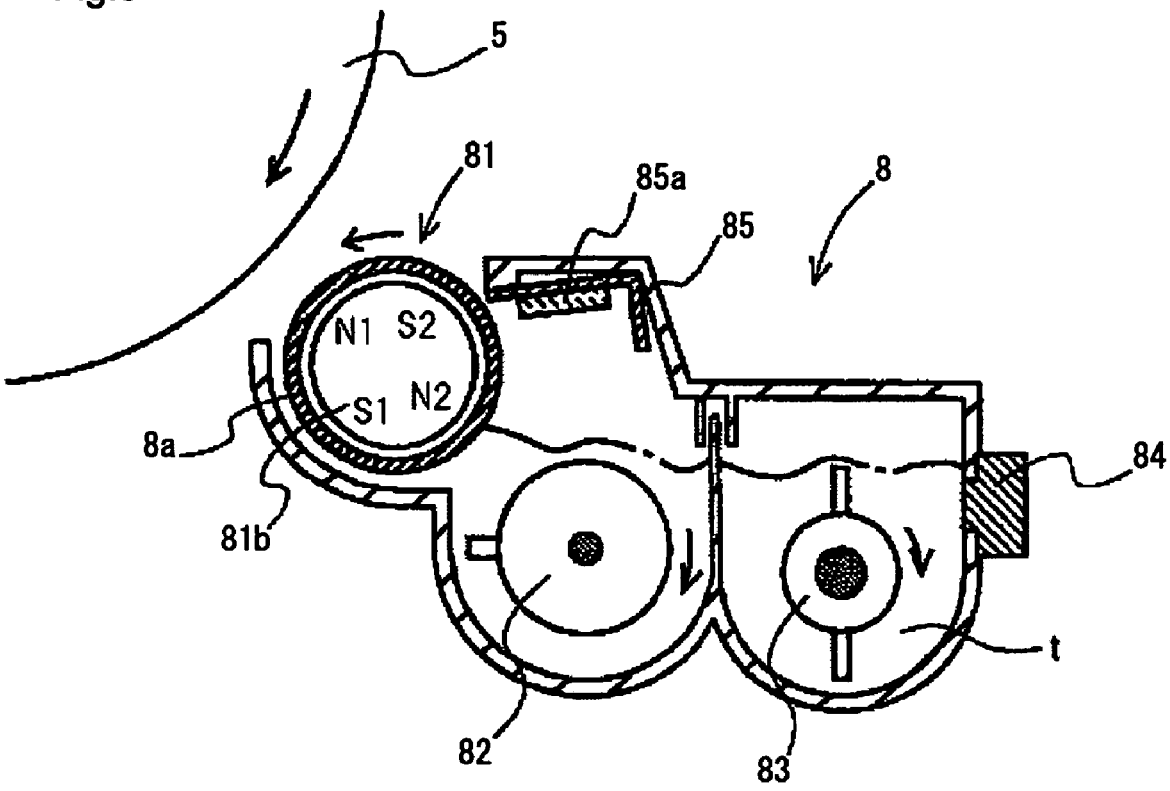
FIG. 9 is an enlarged view of the developing unit.

Further, the image forming apparatus 1 shown in FIG. 1 includes the developing unit 8 shown in FIG. 9. In forming an image having a predetermined pattern using such an image forming apparatus, first of all, a surface of the photoconductor is uniformly primarily charged. Here, the primary charging potential on the surface of the photoconductor may be properly set to, for example, +400 to +500V when amorphous silicon is used. Here, the primary charging may be performed by an arbitrary means which uses a corona charger, a charging roller or the like.

Subsequently, light such as laser beams or the like is radiated based on predetermined image information to form an electrostatic latent image on the surface of the photoconductor. That is, the portion to which the light is radiated assumes a low potential due to this image exposure. Further, the above-mentioned developer which contains the toner charged to the positive polarity jumps to the electrostatic latent image formed as described above to perform the reversal development. That is, the toner charged to the positive polarity is adhered to the portion on the surface of the photoconductor which assumes the low potential due to the radiation of light and hence, the jumping development is performed as described above and a predetermined toner image is formed.

Subsequently, the toner image formed on the surface of the photoconductor in this manner is transferred to a predetermined paper by using a transfer means. As the transfer means, any one of a transfer roller, a transfer belt and a corona charger may be used.

Further, by applying a transfer bias potential of negative polarity to the transfer roller or the transfer belt thus generating an electric field between the toner image and the transfer roller or the transfer belt, the transfer roller or the transfer belt may transfer the toner image to a surface of paper which passes through the gap defined between the photoconductor and the transfer means.

Here, although not shown in the drawing, it may be also preferable to charge a back surface of paper by corona charging to a negative polarity by using a corona charger thus transferring a toner image to a front surface of the paper using an electric field generated by the corona charging.

In this case, it may be preferable to use an AC corona charger for separating the paper in combination with the corona charger for transferring. That is, the back side of the paper to which the toner image is transferred is charged to the negative polarity and hence, it may be necessary to separate the paper from the surface of the photoconductor which is charged to the positive polarity. With the use of the AC corona charging, this separation of the paper may be facilitated.

2. Magnetic Monocomponent Toner

Also in the developing unit according to the second embodiment, the magnetic monocomponent toner which is substantially equal to the magnetic monocomponent toner used in the first embodiment may be used and hence, the detailed explanation is omitted here.

Here, also in the developing unit according to the second embodiment, as the magnetic monocomponent toner, a toner having a center particle size which falls within a range from 6.0 to 7.8 μm, having the sphericity which falls within a range from 0.92 to 0.98, and containing 2.5 to 10.0 volume % of a toner having a volume particle size of 5.04 μm or less is used and, at the same time, assuming a toner quantity per unit area of the toner image as A, the above-mentioned relationship formula (1) is satisfied.

Accordingly, even when the surface roughness (Rz) of the developing sleeve is changed or even when an amorphous-silicon photoconductor is used, it may be possible to obtain the favorable image quality or the like by efficiently allowing the magnetic monocomponent toner to jump to the photoconductor from the developing sleeve.

EXAMPLE

Examples 1 to 3 and Comparison Examples 1 to 5

1. Manufacturing of Magnetic Monocomponent Toner (1) Mixing Step Using Henschel Mixer 100 parts by weight of a styrene-acrylic resin (binding resin, made by Sanyo Chemical Industries Ltd.), 70.0 parts by weight of magnetic powder (EPT-1000, made by Toda Kogyo Corp.), 5.0 parts by weight of Nigrosine dye (charge control agent, made by Orient Chemical Industries, Ltd., N-01), and 3.0 parts by weight of polypropylene wax (wax, made by Sanyo Chemical Industries Ltd. Umex 100TS) are charged into a Henschel mixer 20B (made by MITSUI MINING COMPACY, LTD.) and these components are mixed at a rotational speed of 2500 rpm for five minutes.

(2) Mixing Step with Two-Axial Mixer

Next, the compositions are mixed using a two-axial mixer (PCM-30 made by IKEGAI Ltd.) at a rotational speed of 200 rpm, at a cylinder temperature of 120° C. and charge quantity of 6 kg/hour. Further, by using a dram flaker (made by MITSUI MINING COMPACY, LTD.), the compositions are cooled at a speed of 140 mm/sec and with a plate thickness of 3 to 4 mm.

(3) Pulverizing Step Using Turbo Mill and Classifying Step Using Alpine Classifier Next, the compositions are pulverized by using a turbo mill (T-250 type made by Turbo Mfg.) in a state that a pulverizing time is changed and, at the same time, the pulverized compositions are classified by an Alpine classifier in a state that the classifying condition is changed thus obtaining magnetic monocomponent toners of examples 1 to 3 and comparison examples 1 and 2. Further, in the comparison example 3, a magnetic monocomponent toner is manufactured in the same manner as the example 1 except for that the pulverizing apparatus is changed to a jet mill (IDS-2-type made by Pneumatic Mfg. Co., Ltd.) from the turbo mill.

The pulverization using the turbo mill in the example 1 is performed under the condition in which a charge quantity is set to 10 kg/hour and an air quantity is set to 10 $Nm^3$/min. The pulverization using the turbo mill in the example 2 is performed under the condition in which a charge quantity is set to 8 kg/hour and an air quantity is set to 10 $Nm^3$/min. The pulverization using the turbo mill in the example 3 is performed under the condition in which a charge quantity is set to 10 kg/hour and an air quantity is set to 13 $Nm^3$/min. The pulverization using the turbo mill in the comparison example 1 is performed under the condition in which a charge quantity is set to 7 kg/hour and an air quantity is set to 8 $Nm^3$/min. The pulverization using the turbo mill in the comparison example 2 is performed under the condition in which a charge quantity is set to 10 kg/hour and an air quantity is set to 10 $Nm^3$/min. The pulverization using the turbo mill in the comparison example 3 is performed under the condition in which a charge quantity is set to 10 kg/hour and an air quantity is set to 15 $Nm^3$/min. The pulverization using the turbo mill in the comparison example 4 is performed under the condition in which a charge quantity is set to 7 kg/hour and an air quantity is set to 5 $Nm^3$/min. The pulverization using the turbo mill in the comparison example 5 is performed under the condition in which a charge quantity is set to 12 kg/hour and an air quantity is set to 8 $Nm^3$/min.

(4) Addition Processing

The obtained magnetic monocomponent toner is charged in a Henschel mixer 20B (made by MITSUI MINING COMPACY, LTD.) together with silica (additive made by Wacker Chemie AG., H2050EP), such that an adding quantity of silica becomes 0.8 weight % with respect to a total quantity of the magnetic monocomponent toner. Then, the magnetic monocomponent toner and silica are mixed together at a rotational speed of 2500 rpm for three minutes thus manufacturing the respective magnetic monocomponent toners of the examples 1 to 3 and the comparison examples 1 to 3 as shown in Table 1. That is, through the above-mentioned steps, the magnetic monocomponent toners which differ from each other in the particle size distribution and eventually differ from each other in the volume center particle size, the fine power quantity and the sphericity as shown in Table 1 corresponding to the difference in particle size distribution are obtained.

2. Evaluation of Magnetic Monocomponent Toner (1) Measurement of Volume Center Particle Size and Fine Powder Quantity The center particle size of the magnetic monocomponent toner in table 1 implies the volume center particle size and is measured by using Coulter Multisizer TA-2 made by Beckman Coulter, Inc. Here, the detail of the measuring method is substantially equal to the detail of the measuring method explained in conjunction with the first embodiment.

Further, the fine powder quantity in the magnetic monocomponent toner, that is, a content (volume %) of particles having the particle size of equal to or less than 5.04 μm (fine powder) is measured by using Coulter Multisizer TA-2 made by Beckman Coulter, Inc. simultaneously with the measurement of the center particle size of the magnetic monocomponent toner.

(2) Measurement of Sphericity

Further, the sphericity of the magnetic monocomponent toner is measured by using FPIA-2000 (made by SYSMEX CORPORATION). Here, the detail of the measuring method is substantially equal to the detail of the measuring method explained in conjunction with the first embodiment.

(3) Measurement of Developing Quantity

Further, the developing quantity per unit area (A) is measured by using the respective toners. That is, by using a copying machine of a magnetic monocomponent jumping system (KM-3530 made by Kyocera Mita Corporation) which mounts an amorphous-silicon photoconductor therein, three matted black toner images having a fixed area (3 cm×3 cm=9 $cm^2$) are formed on the photoconductor (photoconductor dram). Next, by using a suction device, the whole quantities of the respective matted black toner images are sucked and the sucked toner is collected on a filter paper in the inside of the suction device. The weights of the sucked toners are calculated based on a change of a weight of the filter paper. Then, an average value of the toner quantities of the respective toner images is obtained based on the calculated toner weights. Further, by dividing the average value of the toner quantities with the predetermined area (9 $cm^2$), the developing quantity per unit area (A) is calculated. Here, conditions for forming the toner images are as follows.

Process speed: 178 mm/sec
Diameter of developing sleeve: 20 mm
Initial surface roughness of developing sleeve (Rz): 4.3 μm
Charge potential: +450V
Developing method: reversal development
Developing bias: DC +200V to +400V
AC 0.25 KV to 2.5 KV
Frequency 2.0 KHz (4) Evaluation of Adhesive Property of Toner By using a copying machine (KM-3530) made by Kyocera Mita Corporation, 10,000 sheets of whole-area black matted images are formed by means of respective toners under image forming conditions substantially equal to the above-mentioned image forming conditions and an adhesive property of toner on a last sheet after printing 10,000 sheets is evaluated in accordance with the following criteria by comparing a black matted image after printing 10,000 sheets with an initial image (a first-printed black matted image). That is, when a white spot-like image defect is observed, the image is evaluated as level 3.0 which is indicative of the presence of adhesion of toner. When a slight image defect is observed, the image is evaluated as level 2.0 which is indicative of the slight presence of adhesion of toner. When an image defect is not observed, the image is evaluated as level 1.0 which is indicative of the absence of adhesion of toner.

Level 1.0: absence of adhesion of toner
Level 2.0: minimal presence of adhesion of toner
Level 3.0: presence of adhesion of toner (5) Image Density (ID)

An image density (ID) of each toner is evaluated by using a A4-size paper in a state that a short side of the paper is determined as the conveying direction of the paper and a measuring image which is constituted by three matted image portions with a size of 3×3 cm is arranged on the paper in a center portion in the conveying direction of the paper at an interval of 10 cm perpendicular to the conveying direction of the paper. With respect to one matted image, by using a reflection density meter (TC-6D, made by Tokyo Denshoku Co., Ltd.), 5 points on the image are measured and an average value of 5 sheets is obtained.

Here, it is found that there is no problem in practical use so long as the image density (ID) assumes a value equal to or more than 1.30 in evaluation criteria of image density (ID).

(6) Fogging Density (FD)

With respect to fog densities (FD) of the respective toners, by using a reflection density meter (TC-6D, made by Tokyo Denshoku Co., Ltd.), 5 points in the non-printed portion of one sheet of the above mentioned measuring image printed paper are measured and an average value of 5 sheets is obtained.

Here, it is found that there is no problem in practical use so long as the fogging density (FD) assumes a value equal to or more than 1.30 in evaluation criteria of fogging density (FD).

TABLE 1

| | Magnetic monocomponent toner | | | | | | |
|---|---|---|---|---|---|---|---|
| | Volume center particle size (μm) | Fine powder quantity (volume %) | Sphericity (-) | Developing quantity (mg/$cm^2$) | Toner adhesive property | Image density (-) | Fogging density (-) |
| Example 1 | 7.2 | 3.5 | 0.96 | 0.75 | 1 | 1.335 | 0.003 |
| Example 2 | 6.0 | 9.7 | 0.98 | 0.80 | 2 | 1.320 | 0.006 |
| Example 3 | 7.8 | 2.5 | 0.92 | 0.70 | 1 | 1.328 | 0.005 |
| Comparison example 1 | 5.7 | 13.2 | 0.95 | 0.53 | 1 | 1.321 | 0.009 |
| Comparison example 2 | 8.5 | 1.5 | 0.93 | 0.91 | 2 | 1.319 | 0.003 |
| Comparison example 3 | 7.4 | 4.2 | 0.90 | 0.54 | 1 | 1.274 | 0.002 |
| Comparison example 4 | 7.1 | 3.8 | 0.99 | 0.88 | 2 | 1.340 | 0.011 |
| Comparison example 5 | 7.3 | 1.0 | 0.98 | 0.92 | 3 | 1.330 | 0.009 |

As may be understood from a result shown in Table 1, with respect to magnetic monocomponent toners in the examples 1 to 3, since the center particle size, the content of fine particles, the sphericity, and the developing quantity A are controlled to values which fall within predetermined ranges, the unnecessary adhesion/retention of toner to the photoconductor are prevented, and an image defect such as black spots or white spots is effectively suppressed. Further, the developing quantity assumes the high value. Accordingly, it may be possible to obtain a high quality image.

On the other hand, with respect to the comparison example 1, when the volume center particle size is small and the fine powder quantity is large, the developing quantity A is decreased, and the adhesion of toner and the fogging are increased. It is estimated that this result is brought about by a fact that a percentage of the toner with high charge quantity is large and hence, although it is difficult for the toner to jump from the developing sleeve to the surface of the photoconductor and the developing quantity A is decreased, the toner which exhibits a large particle size with an extremely small charge quantity (coarse-powder toner) is selectively developed thus increasing both of the adhesion of toner and the image fogging.

Further, with respect to the comparison example 2, when the volume center particle size is large and the fine powder quantity is small, the developing quantity A is increased, and the adhesion of toner is increased. It is estimated that this result may be brought about by a fact that a percentage of the toner with low charge quantity is large, and it is excessively easy for the toner to jump from the developing sleeve to the surface of the photoconductor and hence, the developing quantity A is increased whereby the adhesion of toner is increased.

Further, with respect to the comparative example 3, when the sphericity is small, the developing quantity A is decreased and hence, the image density is slightly decreased. It may be estimated that this result may be brought about by a fact that, the sphericity is small and hence, the toner is not densely filled on the surface of the photoconductor whereby it is difficult for the toner to be developed and the developing quantity A is decreased thus slightly decreasing the image density.

Further, with respect to the comparison example 4, when the sphericity is large, the developing quantity A is increased, the image density is decreased and image fogging is increased. It is estimated that this result is brought about by a fact that although the sphericity is large and hence, the toner is densely filled on the surface of the photoconductor and the toner is easily developed so that the developing quantity A is increased, the sphericity is excessively large and hence, slipping is generated between the surface of the developing sleeve and the magnetic blade so that the favorable triboelectric charge is not generated thus increasing the image fogging.

Further, with respect to the comparison example 5, since the fine powder quantity is excessively small and hence, although the toner is densely filled on the surface of the photoconductor, the developing quantity of the toner is excessively large and hence, the charging quantity cannot be controlled whereby the image fogging and the adhesion of toner are liable to be easily generated.

INDUSTRIAL APPLICABILITY

According to the developing method which uses the magnetic monocomponent jumping system and the developing unit which uses the method of the present invention, even when the surface roughness (Rz) of the developing sleeve is changed with a lapse of time or when the amorphous-silicon photoconductor is used, it may be possible to obtain the favorable image quality or the like by efficiently allowing the magnetic monocomponent toner to jump to the photoconductor from the developing sleeve.

In this manner, the developing method which uses the magnetic monocomponent jumping system and the developing unit which uses the method of the present invention are preferably applicable to image forming apparatuses in a wide range including a laser printer, an electrostatic copying machine, an ordinary paper facsimile device, or a composite apparatus having functions of these devices in combination which adopts the magnetic monocomponent jumping developing system.

Here, when the processing speed of the image forming apparatus is further increased, to be more specific, when the processing speed assumes 250 mm/sec or more and, further, when the processing speed assumes a value which falls within a range from 250 to 400 mm/sec, as the magnetic monocomponent toner, it may be preferable to use a toner having a volume center particle size which falls within a range from 6.2 to 7.8 μm, having the sphericity which falls within a range from 0.93 to 0.97, and setting a toner quantity having a volume particle size of 5.04 μm or less to a value which falls within a range from 2.5 to 10.0 volume % and, at the same time, assuming a toner quantity per unit area of the toner image as A, a following relationship formula (1') is satisfied.

$$0.72\ \text{mg/cm}^2 \leqq A \leqq 0.9\ \text{mg/cm}^2 \quad (1')$$

The invention claimed is:

1. A developing method for forming a predetermined toner image by allowing a magnetic monocomponent toner to jump to a photoconductor from a developing sleeve, and developing an electrostatic latent image formed on the photoconductor, wherein as the magnetic monocomponent toner, a toner having a volume center particle size which falls within a range from 6.0 to 7.8 μm, having the sphericity which falls within a range from 0.92 to 0.98, and setting a toner quantity having a volume particle size of 5.04 μm or less to a value which falls within a range from 2.5 to 10.0 volume % is used and, at the same time, assuming a toner quantity per unit area of the toner image as A, a following relationship formula (1) is satisfied $$0.6\ \text{mg/cm}^2 \leqq A \leqq 0.9\ \text{mg/cm}^2 \quad (1)$$

and assuming the toner quantity per unit area of the toner thin layer formed on the developing sleeve as B, a following relationship formula (3) is satisfied $$0.6\ \text{mg/cm}^2 \leqq B \leqq 0.90\ \text{mg/cm}^2 \quad (3).$$

2. The developing method according to claim 1, wherein assuming the surface roughness of the developing sleeve as Rz, the surface roughness Rz satisfies a following relationship formula (2)

$$3.0\ \mu\text{m} \leqq \text{Rz} \leqq 5.5\ \mu\text{m} \quad (2).$$

3. The developing method according to claim 1, wherein the photoconductor is an amorphous-silicon photoconductor, and a cleaning blade and a cleaning roller are used in combination as a cleaning device.

4. The developing method according to claim 1, wherein the magnetic monocomponent toner is manufactured such that the resin composition is prepared by adding 30 to 120 parts by weight of magnetic powder, 0.1to 10 parts by weight of a charge control agent and 1 to 10 parts by weight of wax into 100 parts by weight of binding resin, the resin composition is pulverized by a turbo mill and, thereafter, the pulverized resin composition is classified using an Alpine classifier.

5. A developing unit for forming a predetermined toner image by allowing a magnetic monocomponent toner to jump to a photoconductor from a developing sleeve, and developing an electrostatic latent image formed on the photoconductor, wherein as the magnetic monocomponent toner, a toner having a volume center particle size which falls within a range from 6.0 to 7.8.μm, having the sphericity which falls within a range from 0.92 to 0.98, and setting a toner quantity having a volume particle size of 5.04 μm or less to a value which falls within a range from 2.5 to 10.0 volume % is used and, at the same time, assuming a toner quantity per unit area of the toner image as A, a following relationship formula (1) is satisfied $$0.6\ \text{mg/cm}^2 \leqq A \leqq 0.9\ \text{mg/cm}^2 \quad (1)$$

and assuming the toner quantity per unit area on the toner thin layer which is formed on the developing sleeve is B, a following relationship formula is satisfied $$0.6\ \text{mg/cm}^2 \leqq B \leqq 0.90\ \text{mg/cm}^2 \quad (3).$$

6. The developing unit according to claim 4, wherein assuming the surface roughness of the developing sleeve as Rz, the surface roughness Rz satisfies the following relationship formula (2)

$$3.0\ \mu\text{m} \leqq \text{Rz} \leqq 5.5\ \mu\text{m} \quad (2).$$

7. The developing unit according to claim 4, wherein the photoconductor is an amorphous-silicon photoconductor and the photoconductor includes a cleaning blade and a cleaning roller in combination as a cleaning device.

* * * * *